United States Patent [19]

Garland

[11] Patent Number: 4,944,624

[45] Date of Patent: Jul. 31, 1990

[54] WRITING INSTRUMENT STAND/HOLDER ATTACHABLE TO CAP POCKET CLIP

[75] Inventor: R. Darryl Garland, Santa Barbara, Calif.

[73] Assignee: Larry K. Roberts, Newport Beach, Calif. ; a part interest

[21] Appl. No.: 411,097

[22] Filed: Sep. 22, 1989

[51] Int. Cl.[5] ..... B43K 23/02; A47F 7/00

[52] U.S. Cl. ..... 401/131; 211/69.1

[58] Field of Search ..... 211/69.1–69.9; 401/131, 88, 195, 52

[56] References Cited

U.S. PATENT DOCUMENTS 575,458 1/1897 Canfield ..... 211/69.1

2,911,106 11/1959 McCormic ..... 211/69.1

3,176,662 4/1965 Williams ..... 211/69.5

4,548,325 10/1985 Hojer et al. ..... 401/131

*Primary Examiner*—Robert A. Hafer

*Assistant Examiner*—Kerry Owens

*Attorney, Agent, or Firm*—Roberts and Quiogue

[57] ABSTRACT

A simple, inexpensive stand for disposable writing instruments characterized by a removable cap having an attached resilient pocket clip. The stand includes the stand base and the pen cap, with the stand base including structure for attaching the cap to the stand base by cooperative engagement with the pocket clip so that the cap is supported by the stand base in a generally upright or inclined position.

16 Claims, 2 Drawing Sheets

WRITING INSTRUMENT STAND/HOLDER ATTACHABLE TO CAP POCKET CLIP

BACKGROUND OF THE INVENTION

The present invention relates to the field of writing instruments, and more particularly to a stand for writing instruments utilizing the writing instrument cap.

Writing instruments have long been known which employ removable caps. Such writing instruments include fountain pens, ball-point pens, felt tip markers and pens, and mechanical pencils. Such instruments generally comprise an elongated barrel suitable for being held in the hand, a writing or marking tip at one end of the barrel, and a removable cap which fits over the writing tip when the instrument is not in use. Commonly the cap includes a pocket clip for clipping the writing instrument to one's pocket.

Many writing instruments sold today are very inexpensive, and once the ink supply is exhausted, the pen is thrown away and not reused. One exemplary such writing instrument is the "uni-ball" pen marketed by Faber-Castell, which, while disposable, also provides a high quality line and is provided with a removable cap which snaps on and off, with the pocket clip being formed on a broad strap of springy metal. Other similar writing instruments are available to the market today, including instruments marketed by BIC, Papermate, Pentel, and Pilot.

Ink pen stands to support a pen on a desk or the like conventionally comprise a weighted base and a writing instrument holder which is supported by the base to receive the writing tip end of the writing instrument. Sometimes the cap is connected to the base by a swivel joint to allow the angle of the cap to be adjusted relative to the base as desired by the user. Such stands are typically used for relatively expensive writing instruments such as expensive fountain pens or ball-point pens. There is therefore a need for a disposable writing instrument stand which is simple and inexpensive.

SUMMARY OF THE INVENTION

A stand is described for writing instruments having a removable cap with a pocket clip. In a general sense, the stand comprises a stand base and means for attaching the cap to the stand base by cooperative engagement with the pocket clip so that the cap is supported by the stand base in a generally upright or inclined position. In one preferred embodiment, the attaching means comprises an inclined wedge surface member defined by the stand base, and a clip end engaging member defined by the stand base and disposed away from the inclined surface member and arranged to engage the clip end when the wedge surface member is disposed between the clip and cap, thereby pivoting the clip away from the cap body. The tension between the clip and wedge member, together with the engaging of the clip end, tends to lock the cap in position on the stand base in an inclined position.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
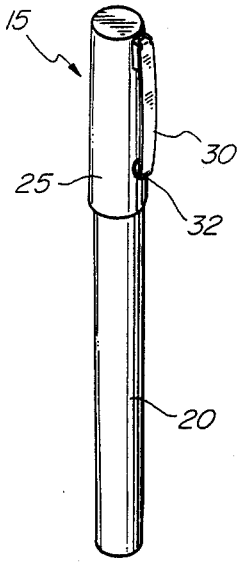
FIG. 1 is a perspective view illustrative of the type of writing instrument with which the present invention may be utilized.
Figure 2:
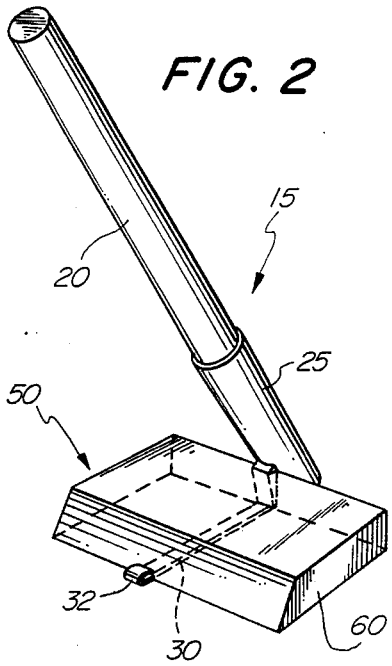
FIG. 2 is a perspective view illustrating a writing instrument stand with a writing instrument in place in accordance with the present invention.

The present invention is intended to be used as a stand for a disposable writing instrument such as the pen illustrated in FIG. 1. The pen comprises a pen barrel with a snap-on cap 25. The cap includes a pocket clip 30 made from a springy material such as stainless steel. One such pen is the "uni-ball" trademark pen described above. The end 32 of the pocket clip 30 in such a writing instrument may be lifted away from the cap 25, the clip 30 pivoting or bending at its point of connection to the cap 25, without the clip breaking off. The invention exploits this resiliency in the clip 30 to attach the cap to a stand base member, thereby forming a writing instrument stand as illustrated in FIG. 2.

In accordance with the invention a stand 50 is provided for the writing instrument shown in FIG. 1, which comprises a stand base 60 and means for attaching the writing instrument cap 25 to the stand base by cooperative engagement with the pocket clip 30, so that the cap 25 is supported by the stand base 60 in the generally upright or inclined position. The stand base 60 is constructed to accept the cap 25 and cap pocket clip 30, with the clip 30 supporting the cap in the inclined position shown. The writing instrument barrel 20 can then be inserted into the cap 25 to support the instrument. The instrument barrel can be rested in the cap, and need not be fully pushed into the full receiving position to allow the barrel to be freely lifted in and out of the cap.

Figure 3:
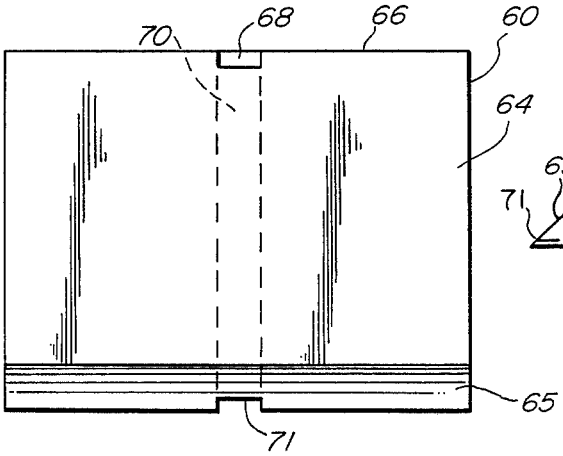
FIGS. 3–5 are respective top, front and side views of the stand base illustrated in FIG. 3.
Figure 5:
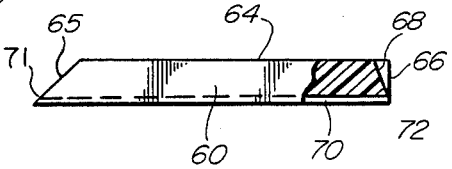
Figure 4:
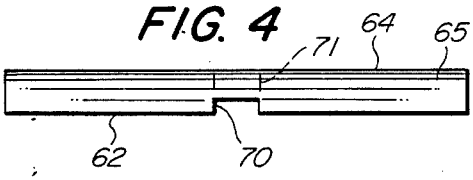

FIGS. 3–5 illustrate a preferred embodiment of the stand base 60 in further detail. The base 60 comprises a planar base surface 62 and a planar top surface 64. The back surface 66 extends generally perpendicular to the base surface 62 and top surface 64. An inclined surface 68 is notched into the back surface 66, and is inclined from the vertical by an angle of about 15 degrees in this embodiment. This angle affects the inclination of the cap 25 once it is positioned on the base 60, and is selected in dependence on the particular inclination angle desired for the cap 25. It will be apparent that the smaller the angle of inclination of the surface 68 from the normal direction to the base surface 66, the closer the cap 25 will be secured to a fully upright position, and the more stress that will be applied to the clip 30 as it is pivoted away from the cap 25.

A groove 70 is formed in the base surface 62 to a depth at least equal to the distance the cap clip 30 is set off by its clip end 32. An exemplary groove depth is 0.0625 inches for the"uni-ball" trademark pen described above. The width of the groove 70 and the inclined surface 68 is selected to be wider than the width of the cap clip 30, and is 0.1875 inches in this example.

The front surface 65 of the base 60 in this embodiment is inclined at an angle of 45 degrees. Any surface of the stand base 60, such as the beveled surface 65, can be used to display a logo or trademark or company name. The base 60 in this exemplary embodiment has a height of 0.3125 inches, a width of 2.5 inches, and a depth dimension from the beveled front face to the rear surface 66 which is selected in dependence on the length of the cap clip 30. For the "uni-ball" trademark pen, this depth dimension is 1.4375 inches. These dimensions are exemplary; other dimensions will also be suitable in particular applications.

The notched, inclined surface 68, the groove 70 and groove edge 71 cooperate with the cap clip 30 to provide a means for attaching the cap 25 to the stand base 60. To attach the cap 25 to the base, the clip 30 is bent or pivoted outwardly from the cap 25 and the cap clip 30 is slid under the base along the groove 70. The clip end 32 will snap over the groove edge 71 at the beveled surface, thereby locking the cap 30 in place. In this position, the cap 25 is fitted against the inclined surface, and is locked in position by the clip extending under the base.

The stand base 60 therefore provides surfaces which contact and support the cap 25 or clip 30. One surface is the inclined surface 68, with the angle of inclination affecting the inclination of the cap when installed on the base. Another surface is the edge of the inclined surface 71 which locks against the tip of the clip 30.

The invention is particularly well suited to use with disposable writing instruments, since, for some instruments, the pen clip may be deformed when attached to the stand base so that it will not thereafter spring back to its original position. Because the invention exploits a part of the writing instrument, i.e., the cap, the manufacturing costs can be substantially reduced in relation to the cost of conventional pen stands.

The base 60 may be fabricated from injection molded plastic, machined metal or plastic such as Plexiglas, wood or other conventional material. The stand base 60 can be fabricated inexpensively, e.g., by injection molding in plastic. Therefore, a stand for disposable writing instruments is provided, thereby meeting the need for a desk stand for such inexpensive pens which heretofore has not been met.

Figure 6:
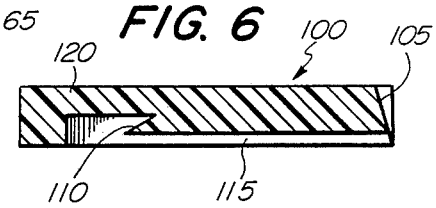
FIG. 6 is a side cross-sectional view of a first alternate form of a stand base in accordance with the invention.

Alternate embodiments of the stand base comprising the invention are illustrated in FIGS. 6–9. The stand base 100 of FIG. 6 is shown in a cross-sectional view. The base 100 comprises a notched inclined surface 105, a groove 115 formed in the bottom surface and a groove edge 110, which generally correspond to respective elements 68, 70 and 71 of the embodiment of FIG. 1. The base structure 100 includes the further feature of the overhang structure 120 which overhangs and essentially covers the groove edge 110. If the base 100 is fabricated from an opaque material, the clip 30 and clip end 32 will be hidden from view when the cap 25 is installed on the base 100, thereby presenting a cleaner appearance.

Figure 7:
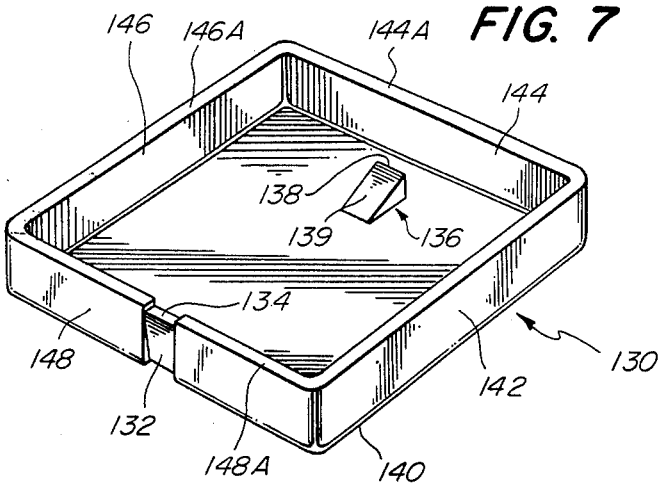
FIG. 7 is an inverted perspective view of a second alternate form of a stand base in accordance with the invention.

FIG. 7 illustrates a second alternate stand base 130 embodying the invention. To better illustrate the invention, the stand base 130 is shown in an inverted position in FIG. 7. The top surface 140 of the base 130 is essentially planar. As illustrated in FIG. 7, the base 130 is generally in the form of an open box, with the base 130 being open from its base. The four walls 142, 144, 146 and 148, which comprise the base 130, extend from the top planar surface 140 and each terminates in corresponding edges 142A, 144A, 146A, and 148A. The edges are coplanar and the base 130 rests on the edges when the stand base 130 is in use. The base 130 further comprises means for attaching a writing instrument cap 25 to the base 130 by cooperative engagement with the pocket clip 30 so that the cap is supported in a generally upright or inclined position. This attaching means comprises the inclined surface 132 which corresponds generally to the inclined surface 68 of the embodiment of FIGS. 2–5. A recessed area 134 is formed in the edge 148A to a depth sufficient to receive the pocket clip 30 of the cap 25. A ramp shaped protrusion 136 extends from the underside of the top surface structure 140, comprising an inclined surface 139 terminating in an abrupt edge to define a shoulder surface 138. The relieved area 134 and the open configuration of the base structure 130 take the place of the groove 70 of the embodiment of FIGS. 2–5, with the protrusion structure 136 taking the place of the groove edge 71. The pocket clip end 32 is captured by snapping over the abrupt shoulder 138 to secure the cap 25 in position on the stand base 130. An advantage of the embodiments of FIG. 7–9 is that these stand base structure are particularly well-suited to inexpensive mass fabrication using injection molding techniques.

Figure 8:
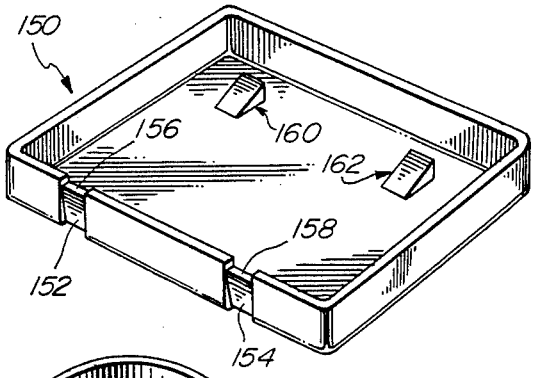
FIG. 8 is an inverted perspective view of a third alternate form of a stand base in accordance with the invention.

The third alternate embodiment of FIG. 8 is generally similar to the embodiment of FIG. 7, except that means are provided for securing two writing instrument caps in position on the stand base 150 to form a double writing instrument or pen stand. The base 150 is shown for clarity in the inverter position, in like fashion to the embodiment of FIG. 7. Thus, one cap can be secured to the base 150 by cooperative engagement with inclined surface 152 and protrusion 160 via relieved area 156. The second cap can be secured to the base by cooperative engagement with inclined surface 154 and protrusion 162 via relieved area via 158.

Figure 9:
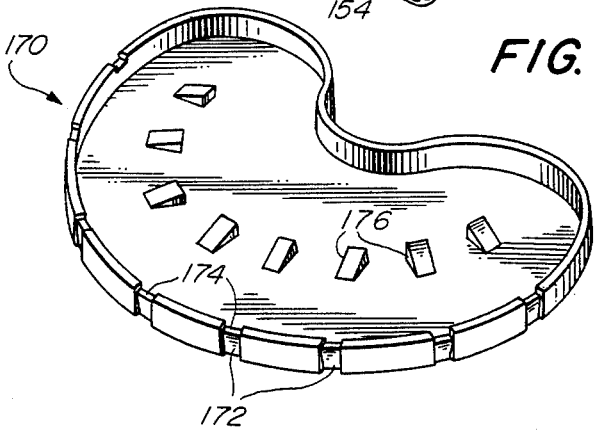
FIG. 9 is an inverted perspective view of a fourth alternate form of a stand base in accordance with the invention.

A fourth alternate embodiment is illustrated in FIG. 9 and comprises a multiple writing instrument stand base 170, characterized by its artist's palette shape and by means for securing multiple (eight in this example) writing instrument caps to the base 170 by cooperative engagement with respective cap pocket clips. The stand base 170 is illustrated in an inverted position, and its construction is generally similar to the stand bases 130 and 150. To accommodate eight caps, the stand base structure includes, for each cap, an inclined surface 172, relieved area 174 and protrusion 176 to provide the means for attaching each cap 25 to the stand base 170 by cooperative engagement with the cap clip 30. The stand base 170 can be used to provide a base for a multicolor set of writing instruments.

It is understood that the above-described embodiments are merely illustrative of the possible specific embodiments which may represent principles of the present invention. Other arrangements may readily be devised in accordance with these principles by those skilled in the art without departing from the scope of the invention. Moreover, while the invention has been described with respect to writing instruments having a pocket clip made of a springy metal, the invention can be employed with writing instruments employing a clip mechanism which is designed such that it will not break when pressure is applied to extend the clip. For example, the clip may be fabricated of resilient plastic. The pocket clip may even be a clip-on or slide-on separate unit for use with a cap which does not include a pocket clip, such as the well-known type of clip which is slipped onto a wooden lead pencil and can be removed for reuse on other pencils. Further, the stand can be wall-mounted, affixed to a vehicle dashboard, workstation or any other surface where writing instruments are commonly in use.

What is claimed is:

1. A stand for writing instruments having a barrel and a removable cap, the cap characterized by a cap body to which is affixed a pocket clip of a spring material, the clip being attached to the cap at a first end of the clip, and wherein the pocket clip second end terminates in a clip protrusion, the stand comprising:

a stand base structure; and means for attaching the cap to the stand base by cooperative engagement of the stand base with the pocket clip, so that the cap is supported by the stand base in a generally upright or inclined position, and wherein said attaching means is defined by said stand base and comprises means for supporting the clip body and cap such that the second end of the pocket clip is pivoted away from the cap body, and wherein said supporting means comprises a first structure defined by said stand base for wedging between the cap body and pocket clip, and a second structure defined by said stand base for engaging the clip protrusion, thereby locking the clip and cap in place in said generally upright or inclined position;

whereby the writing instrument barrel may be inserted into the cap being supported by the stand base so that the barrel is supported in a generally upright or inclined position.

2. The writing instrument stand of claim 1 further comprising means for attaching a plurality of writing instrument caps to said stand base, each by cooperative engagement with the pocket clip.

3. A stand for writing instruments having a barrel and a removable cap, the cap characterized by a cap body to which is affixed a pocket clip of a springy material, the clip being attached to the cap at a first end of the clip, the stand comprising:

a stand base structure; and means for attaching the cap to the stand base by cooperative engagement of the stand base with the pocket clip, so that the cap is supported by the stand base in a generally upright or inclined position, said attaching means comprising:

a cap bearing surface defined by said stand base;

a pocket clip end engaging member defined by said stand base and disposed away from the cap bearing surface, said engaging member arranged to engage the pocket clip end when the cap bearing surface is disposed between the clip end and the cap body, thereby pivoting the pocket clip second end away from the cap body, the tension between the springy clip material and cap bearing surface, together with the engaging of the pocket clip second end, tending to lock the cap in position on the stand base, the position being an inclined one;

whereby the writing instrument barrel may be inserted into the cap being supported by the stand base so that the barrel is supported in a generally upright or inclined position.

4. The writing instrument stand of claim 3 wherein the stand base is further characterized by a substantially planar top surface, a substantially planar bottom surface having an elongated groove defined therein to accept the pocket clip, and a back surface extending between the top and bottom surfaces, and wherein said cap bearing surface is defined in said back surface, and said clip end engaging member is defined in said groove.

5. The writing instrument stand of claim 4 wherein said top surface comprises structure which overhangs over said groove, and said stand base is further characterized by a front surface extending between the top and bottom surfaces, whereby the groove is hidden from view by the overhanging structure and the front surface.

6. The writing instrument stand of claim 3 wherein said stand base comprises a top surface member, and a downwardly extending support structure defined by one or more side walls terminating in edges which contact a surface on which the stand base rests, the stand base being substantially open from the bottom thereof, and wherein said cap bearing surface is defined in said wall structure, said clip end engaging member is defined by a protrusion extending downwardly from the top surface, and a clip receiving relieved area is defined in said wall edge adjacent said inclined surface.

7. The writing instrument stand of claim 6 further comprising means for attaching a plurality of writing instrument caps to said stand base, each by cooperative engagement with the pocket clip, characterized by a plurality of said cap bearing surfaces defined in said side wall structure, a plurality of said protrusions extending downwardly from the top surface, and a plurality of said clip receiving areas, each defined in said wall edge adjacent a corresponding one of said inclined surface members.

8. The writing instrument stand of claim 7 wherein said stand base has a configuration in the form of an artist's palette.

9. A stand for writing instruments having a barrel and a removable cap, the cap characterized by a cap body to which is affixed a pocket clip of a springy material, the clip being attached to the cap at a first end of the clip, the stand comprising:

a stand base;

the removable cap of the writing instrument; and means for attaching the cap to the stand base by cooperative engagement with the pocket clip, so that the cap is supported by the stand base in a generally upright or inclined position, said attaching means comprising:

a cap bearing surface defined by said stand base;

a pocket clip end engaging member defined by said stand base and disposed away from the cap bearing surface, said engaging member arranged to engage the second clip end when the cap bearing surface is disposed between the pocket clip and the cap body, thereby pivoting the pocket clip second end away from the cap body, the tension between the springy clip material and cap bearing surface, together with the engaging of the pocket clip second end tending to lock the cap in position on the stand base, the position being an inclined one;

whereby the writing instrument barrel may be inserted into the cap being supported by the stand base so that the barrel is supported in a generally upright or inclined position.

10. The writing instrument stand of claim 9 wherein the stand base is further characterized by a substantially planar top surface, a substantially planar bottom surface having an elongated groove defined therein to accept the pocket clip, and a back surface extending between the top and bottom surfaces, and wherein said cap bearing surface is defined in said back surface, and said pocket clip end engaging member is defined in said groove.

11. The writing instrument stand of claim 10 wherein said top surface comprises structure which overhangs over said groove, and said stand base is further characterized by a front surface extending between the top and bottom surfaces, whereby the groove is hidden from view by the overhanging structure and the front surface.

12. The writing instrument stand of claim 9 wherein said stand base comprises a top surface member, and a downwardly extending support structure defined by one or more side walls terminating in edges which contact a surface on which the stand base rests, the stand base being substantially open from the bottom thereof, and wherein said cap bearing surface is defined in said wall structure, said clip end engaging member is defined by a protrusion extending downwardly from the top surface, and a clip receiving relieved area is defined in said wall edge adjacent said cap bearing surface.

13. The writing instrument stand of claim 12 further comprising means for attaching a plurality of writing instrument caps to said stand base, each by cooperative engagement with the pocket clip, characterized by a plurality of said cap bearing surfaces defined in said side wall structure, a plurality of said protrusions extending downwardly from the top surface, and a plurality of said clip receiving areas, each defined in said wall edge adjacent a corresponding one of said inclined surface members.

14. The writing instrument stand of claim 13 wherein said stand base has a configuration in the form of an artist's pallette.

15. A stand for writing instruments having a barrel and a removable cap, the cap characterized by a cap body to which is affixed a pocket clip of a springy material, the clip being attached to the cap at a first end of the clip, the stand comprising:

a stand base;

the removable cap of the writing instrument, said cap further characterized in that the pocket clip second end terminates in a clip protrusion; and means for attaching the cap to the stand base by cooperative engagement with the pocket clip, so that the cap is supported by the stand base in a generally upright or inclined position, said attaching means comprises means defined by said stand base for supporting the clip body and cap such that the free, second end of the clip is pivoted away from the cap body, said supporting means comprising a first structure defined by said stand base for wedging between the cap body and pocket clip, and a second structure defined by said stand base for engaging the clip protrusion, thereby locking the clip and cap in place in a generally upright or inclined position;

whereby the writing instrument barrel may be inserted into the cap being supported by the stand base so that the barrel is supported in a generally upright or inclined position.

16. The writing instrument stand of claim 15 further comprising means for attaching a plurality of writing instrument caps to said stand base, each by cooperative engagement with the pocket clip.

* * * * *